US011817235B2

(12) United States Patent
Herrmann et al.

(10) Patent No.: US 11,817,235 B2
(45) Date of Patent: Nov. 14, 2023

(54) DEVICE AND METHOD FOR THE AUTOMATIC ASSEMBLY OF A PAIR OF WIRES

(71) Applicant: LEONI BORDNETZ-SYSTEME GMBH, Kitzingen (DE)

(72) Inventors: Tim Herrmann, Sulzfeld (DE); Roland Jaecklein, Volkach (DE); Sarah Kopp, Oberpleichfeld (DE); Paulo Martins, Kitzingen (DE); Ana Carolina Roquez Buitrago, Wuerzburg (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 702 days.

(21) Appl. No.: 16/876,327

(22) Filed: May 18, 2020

(65) Prior Publication Data

US 2020/0365297 A1 Nov. 19, 2020

(30) Foreign Application Priority Data

May 17, 2019 (DE) ..... 102019207253

(51) Int. Cl.
*H01B 13/02* (2006.01)
*H01R 43/20* (2006.01)
*H01R 43/28* (2006.01)

(52) U.S. Cl.
CPC ..... *H01B 13/0207* (2013.01); *H01B 13/0221* (2013.01); *H01R 43/20* (2013.01); *H01R 43/28* (2013.01); *Y10T 29/53243* (2015.01)

(58) Field of Classification Search
CPC .. Y10T 29/53243; H01R 43/20; H01R 43/28; H01B 13/0207; H01B 13/0221
See application file for complete search history.

(56) References Cited

U.S. PATENT DOCUMENTS 4,967,470 A * 11/1990 Folk ..... H01R 43/20 29/748
5,315,756 A 5/1994 Jurjevic et al.
(Continued)

FOREIGN PATENT DOCUMENTS

EP 3301768 A1 4/2018
EP 3301769 A1 4/2018
(Continued)

OTHER PUBLICATIONS

Yin et al, "Grasping model and experimentof a soft robot gripper with variable stiffness," 2017 IEEE International Conference on Cybernetics and Intelligent Systems (CIS) and IEEE Conference on Robotics, Automation and Mechatronics (RAM), 2017, pp. 134-139. (Year: 2017).*

*Primary Examiner* — A. Dexter Tugbang
(74) *Attorney, Agent, or Firm* — Laurence A. Greenberg; Werner H. Stemer; Ralph E. Locher

(57) ABSTRACT

The device and the method are used for the automatic assembly of an in particular twisted pair of wires, wherein the pair of wires has two wire elements each with a contact element arranged at one end of a wire end. The respective contact elements are brought into a predetermined rotary position by gripping the wire pair with a main gripper which has an axis of rotation about which it can rotate, and wherein the wire ends are each gripped by a gripping element. The respective contact element is brought into the predetermined rotary position by rotating the pair of wires by way of the main gripper.

19 Claims, 2 Drawing Sheets

(56) References Cited

U.S. PATENT DOCUMENTS

| | | | | |
|---|---|---|---|---|
| 2017/0133809 | A1* | 5/2017 | Larisch | H01R 43/20 |
| 2017/0320213 | A1* | 11/2017 | Helmick | H01R 43/20 |
| 2018/0093849 | A1 | 4/2018 | Estermann et al. | |
| 2018/0097328 | A1 | 4/2018 | Bussmann et al. | |
| 2018/0183200 | A1 | 6/2018 | Kobayashi et al. | |

FOREIGN PATENT DOCUMENTS

| | | | | | |
|---|---|---|---|---|---|
| JP | H09171879 | A | | 6/1997 | |
| JP | 2014220213 | A | * | 11/2014 | G01B 11/002 |
| WO | 9115043 | A1 | | 10/1991 | |
| WO | 0249046 | A1 | | 6/2002 | |
| WO | 2018163260 | A1 | | 9/2018 | |

* cited by examiner

DEVICE AND METHOD FOR THE AUTOMATIC ASSEMBLY OF A PAIR OF WIRES

CROSS-REFERENCE TO RELATED APPLICATION

This application claims the benefit, under 35 U.S.C. § 119, of German Patent Application DE 10 2019 207 253.4, filed May 17, 2019; the prior application is herewith incorporated by reference in its entirety.

BACKGROUND OF THE INVENTION

Field of the Invention

The invention relates to a device and method for the automatic assembly of a pair of wires.

When assembling electrical wires, especially a twisted pair of wires, wherein each wire having contact elements at its wire end, the contact elements are inserted into a connector housing. The contact elements must be positioned correctly in the connector housing. In the case of twisted pairs, it is often necessary to rotate the contact elements of the two wires differently to bring it into the correct rotary position.

EP 3 301 768 A1 describes a device for the correct positional alignment of assembled wire ends of a twisted pair of wires. The device has two grippers arranged one behind the other in the longitudinal direction of the wire. Each of the grippers is provided for clamping one of the wire ends and at the same time for loosely feeding through the other wire end. In order to bring a respective wire end into a correct rotary position, the twisted wire pair is rotated by means of a rotary gripping device, whereby one of the wire elements is loosely guided in the two grippers so that it is twisted and aligned in a predetermined rotary position. The wire end is then fixed in the gripper in the aligned rotary position.

According to EP 3 301 769 A1 a mounting device is provided for equipping a connector housing with such a twisted pair of wires with aligned wire ends. For this purpose, the wire ends aligned in the correct rotary position are first transferred to the assembly device. The assembly device has two grippers arranged one behind the other in the longitudinal direction, which are designed for clamping the one wire end and for feeding the other wire end. The two grippers can move independently of each other in the longitudinal direction, so that the wire ends can be moved in the longitudinal direction independently of each other.

SUMMARY OF THE INVENTION

An object of the invention is to provide a device as well as a method in which automatic alignment of the contact elements is possible during the assembly of a pair of wires.

The object of the invention is achieved by a device for the automatic assembly of a pair of wires, which has at least two wire elements each with a contact element arranged at the end, with

- a control unit for controlling the operation of the device,
- a main gripper for gripping the pair of wires, which is rotatable about an axis of rotation extending in a longitudinal direction,
- two gripping elements for respectively gripping a wire end of the respective wire element, and

- a control unit for controlling the main gripper and the two gripping elements in such a way that in operation
  - the wire ends are gripped by the gripping elements
  - the wire pair is gripped with the main gripper,
  - the respective contact element is brought into a predetermined rotary position by rotating the main gripper,
  - the two gripping elements are arranged laterally next to one another with respect to the longitudinal direction,
  - the control device and the two gripping elements are designed in such a way that during operation of the device a movement of the gripped wire ends takes place, said movement is selected from a translational alignment and a rotary alignment of the gripped wire ends relative to one another.

The object of the invention is further achieved by a method for the automatic assembly of a pair of wires with the aid of a device, the pair of wires having two wire elements each with a contact element arranged at one end of a wire end, the respective contact element being brought into a predetermined rotary position with the following steps:

- the pair of wires is gripped by a main gripper, the main gripper having an axis of rotation about which it is rotatable,
- the device having two gripping elements and the wire ends are each gripped by one of the gripping elements,
- the respective contact element is brought into the predetermined rotary position by rotating the pair of wires by means of the main gripper,
- the two gripping elements are arranged laterally next to one another with respect to the longitudinal direction and an alignment of the gripped wire ends is performed, said alignment is selected from a translational and a rotary alignment.

Preferred embodiments and variants are the subject of the dependent claims. The advantages and preferred configurations mentioned with regard to the device are to be transferred to the method and vice versa.

For a better understanding, the features of the device and the corresponding method features are described in parallel below.

The device is designed for automatic alignment of contact elements of a wire pair to a respective target position. Alignment to a target position is understood to mean an alignment to a specified target rotary position of the contact elements with respect to a longitudinal or plug-in axis, and also a lateral alignment of the contact elements relative to one another and/or an angular orientation and alignment of the contact elements relative to one another.

The wire pair generally comprises two wire elements, whereby the contact elements are each arranged at the end of one wire element. The wire pair is in particular a twisted wire pair. The wire elements are preferably single cores, i.e. bare electrical conductors (solid conductor or stranded conductor) surrounded by an insulation sheath. In the simplest case, the wire pair is thus two twisted single wires.

The alignment is carried out in relation to a specified target position which the contact elements must assume in relation to a contact receptacle of a connector housing into which the contact elements are subsequently inserted for alignment. The target position is composed of a target rotary position and a lateral target position and/or a target angular position at which the respective contact element is to be oriented in relation to a longitudinal direction.

A respective contact element is automatically brought into the specified position. The predetermined position, in particular the predetermined rotary position (rotary position with respect to the longitudinal axis in which the wire extends), is determined in particular by a desired position of, for example, a latching lug of the contact element which can only be inserted into the connector housing in a certain predetermined rotary position, so that the latching lug engages with a latching element corresponding to the latching lug arranged in the connector housing, for example. Only then is the contact element correctly arranged both electrically and mechanically within the connector housing. The specified position of the contact element, in particular the distance between the two contact elements and the angular position of the contact element are also determined by the general conditions provided by the connector housing. The angular position of the contact element is typically chosen parallel to the axis of an opening for the contact element to be inserted in the connector housing.

For alignment in the respective predetermined rotary position, the device has a main gripper for gripping the pair of wires, which can be rotated about a rotary axis extending in a longitudinal direction. The main gripper can thus be rotated about its own longitudinal axis and is preferably designed like a pair of pliers for non-rotary gripping of the wire pair.

In addition to the main gripper, the device also has two gripping elements for gripping a wire end of the respective wire element. This means each of the gripping element grips a wire end of a wire element. The main gripper is preferably positioned centrally between the two gripping elements. The two gripping elements are designed both for loose guiding and for clamping the respective wire end in a fixed rotary position. The gripping elements are designed for gripping wire elements of different diameters. Loose guiding means that the respective gripping element grips the respective wire end in such a way that it is held or guided by the gripping element, but a longitudinal and/or rotary movement of the respective wire element is possible. In this case the end of the wire is only guided by the respective gripping element. In contrast, clamping means that the respective wire element is held clamped by the respective gripping element in such a way that no longitudinal and/or rotary movement of the wire element is possible.

The main gripper grips the wire pair in a rear area spaced from the contact elements. For example, a few centimetres (e.g. ~3-10 cm) behind the contact elements—seen in the longitudinal direction. In the case of a twisted pair of wires, it is preferable to grip the pair in an area in which the wire pair is already twisted. This area is understood to be, for example, the last 2 cm to 3 cm of the twisted area of the wire pair before the twisting ends and the two wire ends are separated from each other. So, the main gripper grips the wire pair about 2 cm to 3 cm before the end of the twisting.

The pair of wires is therefore held at three positions, namely by the main gripper and the two gripping elements. The wire pair itself is held by the main gripper and each of the wire ends are gripped by one of the gripping elements.

The gripping elements therefore grip the wire ends in front of the main gripper either at the contact element, but preferably in the area between the contact element and the main gripper.

The device also includes a control unit for controlling the main gripper and the two gripping elements. The control of the main gripper and the two gripping elements is during operation effected in such a way that, as already mentioned above, the wire ends are gripped by the gripping elements and the wire pair is gripped by the main gripper.

In order to bring the respective contact element into the specified (rotary) position, the main gripper is rotated. The wire end with the respective contact element to be rotated is preferably held loosely by the gripping element assigned to it. This means that it is held in the position specified by the gripping element, while at the same time rotation about its longitudinal axis is possible. By rotating the wire pair around its longitudinal axis, the contact element is therefore automatically rotated around its longitudinal axis.

In addition to aligning the wire ends in the correct rotary position, the wire ends can also be aligned in a lateral nominal position and/or in a desired angular orientation. To enable such an additional alignment in addition to the rotary orientation of the individual wire end, the two gripping elements are arranged laterally next to each other with respect to the longitudinal direction. The two gripping elements are therefore used to grip the wire ends individually and independently of each other laterally.

Furthermore, the two gripping elements are designed and are controlled during operation by means of the control unit in such a way that the gripped wire ends perform a translatory and/or a rotary movement relative to each other for further alignment. The device is therefore designed in such a way that, in addition to the alignment in the specified rotary position, a further alignment can be carried out by means of a translational and/or rotary movement of the gripping elements.

All in all, this alignment of the contact elements by means of the gripping elements in several dimensions during operation enables the respective contact element to be individually aligned in a predetermined target position.

The term "translational movement" is generally understood to mean, on the one hand, a lateral displacement of the gripped wire elements perpendicular to the longitudinal direction. In addition, "translational movement" also means a relative displacement of the two wire ends in the longitudinal direction. The movements of the gripping elements and thus of the wire ends and the contact elements attached to them are relative to each other and in particular independent of each other.

The term "rotary movement" is understood to mean—irrespective of the rotation of the entire pair of wires—in addition a rotation of the individual wire element about a swivel axis. This swivel axis is for example a swivel axis running parallel to the longitudinal direction and parallel to the axis of rotation of the main gripper. However, this parallel swivel axis preferably does not coincide with the axis of rotation of the main gripper. Alternatively, it is a swivel axis oriented at an angle, but preferably not at right angles to the longitudinal direction, so that a tilting movement of the contact element can be carried out relative to the longitudinal direction.

In particular, the gripping elements enable for the two wire ends to be moved laterally relative to each other and especially independently of each other. "Lateral displacement" in this context means in particular that they can be moved perpendicular to the longitudinal direction when viewed along the longitudinal direction within a projected plane.

The lateral alignment enables, for example, the lateral distance of the contact elements to be adapted to different lateral nominal distances. This allows the device to be used universally for different connector housings with different plug patterns. This lateral relative displacement of the contact elements to each other also enables the wire ends to be positioned parallel next to each other, on top of each other, diagonally next to each other or even at a distance from each other over several locking distances. All in all, the additional lateral degree of freedom also allows individual assembly of different types of connector housings and/or plug patterns.

These movements—also superimposed movements—provide further degrees of freedom of movement, which enable further alignment movements, namely lateral alignment laterally to the longitudinal direction, alignment of the angular orientation of the wire ends/contact elements with respect to the longitudinal direction and, if necessary, translational alignment in the longitudinal direction. These alignment movements—especially the first two mentioned—are carried out during operation.

In a preferred embodiment, the device is also used to insert the contact element, which has been brought into the correct rotary position, into the connector housing while maintaining the specified rotary position.

In particular, the control unit is designed in such a way that the two contact elements are successively brought into the specified rotary position. This is done by first bringing the one, first contact element into the predetermined rotary position by rotating the pair of wires by means of the main gripper. The first contact element is only loosely guided by the respective gripper element, so that a rotation of the wire end and thus of the first contact element is made possible by a rotation of the wire pair. The other, second contact element is held rotary fixed by its gripping element so that no rotation takes place. Preferably, the second, rotary fixed contact element is aligned further (lateral position and/or angular position), for example while the first contact element is brought into the desired rotary position.

The rotation of the wire pair by means of the rotation of the main gripper around the axis of rotation thus initially causes the first contact element, which is only loosely guided, to rotate. Once the first contact element has been brought into the specified rotary position by the rotation of the wire pair, the gripping element assigned to it fixes it in a rotary fixed position so that the first contact element is held in the specified rotary position. Subsequently, the further (second) contact element is brought into the predetermined rotary position by rotating the wire pair by means of the main gripper. In this case, analogous to the first contact element, the second contact element is only loosely guided by its assigned gripping element, so that the rotation of the wire pair by the main gripper enables a rotation of the wire end and thus of the second contact element until it also reaches the predetermined rotation position.

Preferably, the contact elements are moved to the specified rotary position by rotating the wire pair by means of the main gripper in different directions. This means that for the alignment of one contact element into the predetermined rotary position, the main gripper and thus the pair of wires turns to the left, for example, when viewed in the longitudinal direction, while the main gripper and thus the pair of wires turns to the right to move the other contact element into the predetermined rotary position. The rotation in different directions of rotation is based on the idea that this has little or no influence on the twisting of the wire pair. In other words, for example, any overtwisting that may occur is compensated by the rotation of the wire pair to align the first contact element by rotating the wire pair in the opposite direction when aligning the other contact element.

The further alignment of the contact elements, especially their lateral relative displacement and/or the alignment into the desired angular orientation is carried out before, after, during or alternating to the rotation of the wire elements for alignment in their desired rotary position. Due to the independent movability of the two gripping elements, the two contact elements are, for example, aligned differently at the same time, i.e. they are guided differently and perform different movements.

The control unit is also designed to control the main gripper and the two gripping elements fully automatically. This means that the control of the main gripper as well as the two gripping elements is carried out especially without manual interaction by an operator.

The contact elements are preferably inserted into the connector housing only after both contact elements have been aligned in the specified target position. Alternatively, the first, already aligned contact element is already inserted before the second contact element is aligned and then inserted.

Preferably, a sensor unit is provided to detect the current rotary position of the respective contact element. The control unit is designed to control the main gripper as well as the two gripping elements depending on sensor information provided by the sensor unit, in particular to align the wire elements and especially the wire ends.

Preferably, the sensor unit has a camera that is set up to detect an alignment of a side profile of the contact element. Since the contact elements are usually not rotary symmetrical, the current rotary position can often be determined by means of a side profile of the contact element. Alternatively, the contact elements have markings on them which can be used for alignment.

The main gripper and the gripping elements are suitably arranged, in particular fixed, on a common support. In this case, the main gripper is preferably attached to the common support in such a way that it is located between the two gripping elements—at least when viewed from above in the direction of the longitudinal axis of the main gripper. The support is in particular plate-shaped and is also called a base plate.

The support itself is preferably designed for attachment to an adjustment mechanism, in particular a robot arm, and is also attached to such an adjustment mechanism during operation. By the arrangement on an adjustment mechanism, the support with the attached grippers can be moved to desired target positions, where the assembly of connectors with the wire elements is to take place.

Especially the arrangement of the main gripper as well as the gripping elements on the common support has proven to be advantageous, since only the support has to be attached to the adjustment mechanism, preferably to the robot arm. For this purpose, the support has, for example, appropriate fastening means for a preferably reversible fastening to the robot arm.

According to a preferred embodiment, a movable kinematic unit is provided for each gripping element. For example, each of the gripping elements is attached to the assigned kinematic unit or is part of the kinematic unit. The kinematic unit is, for example, arranged between the respective gripping element and the support. Thus, the two gripping elements are attached indirectly to the support via the kinematic units. The kinematic units ensure a particularly precise alignment of the wire ends as well as sufficient mobility of the gripping elements to both grip the wire ends and align them for the above-mentioned assembly. The respective kinematic unit is designed for the further alignment (in addition to the alignment in the nominal rotary position) of the respective contact element. The two kinematic units are independent of each other, so that the two gripping elements can be moved independently of each other.

Preferably, the gripping elements can be moved within an X-Y plane that is perpendicular to the longitudinal direction. In general, the gripping elements in connection with the kinematic units are designed for movement within the projection plane. This means that the gripping elements—and thus also the contact elements held by them—can perform a lateral movement during operation, i.e. a movement sideways to the longitudinal direction. The movement of the gripping elements takes place, for example, strictly within a plane perpendicular to the longitudinal axis. A movement within the projection plane is also understood to be a movement in which there is additionally a movement component in the direction of the longitudinal direction, for example a spiral movement.

In addition, or as an alternative to a movement by means of the kinematic units, a movement (of the gripped contact elements) via a linear guide is provided, which allows a displacement in X and/or Y direction. This preferably allows a lateral alignment of the wire ends perpendicular to the longitudinal direction.

In addition, or as an alternative to movement within the X-Y plane, a rotary movement of the kinematic unit is preferably provided to exert the rotary movement about an axis parallel to the axis of rotation. In particular, the axis is at a distance from the axis of rotation. This rotary movement, e.g. swivel movement, enables the contact element to be rotated, especially in the projection plane. This rotary movement is overlaid with a linear movement in particular.

Preferably, the kinematic unit enables a tilting movement, i.e. a tilting of a central axis of the gripping elements relative to the longitudinal direction or the axis of rotation is possible. The central axis of the respective gripping element is understood to be the (central) axis of the respective wire element, which is held by the gripping element. This enables a desired axis-parallel alignment of the contact element with respect to a plug-in direction or with respect to a central axis of a plug-in opening into which the contact element is to be inserted.

In preferred embodiment, the two gripping elements each comprise one gripping arm, with the two gripping arms oriented towards each other in the direction of the axis of rotation. In particular, the gripping arms are attached to the kinematic units, which are each arranged laterally next to the longitudinal direction and thus also laterally next to the main gripper. The kinematic units are preferably arranged together with the main gripper on the common support.

Preferably, each gripper arm is divided into two partial arms which can be moved relative to each other to grip the respective wire end. For this purpose, the two partial arms are supported in particular in the linear guide mentioned above. Preferably, one of the partial arms is fixed and the other partial arm is movable. The movable bearing of the at least one partial arm in the linear guide is preferably only used to grip the respective wire end of the wire element. The adjustment/movement of the gripped wire element, e.g. within the X-Y plane, i.e. the lateral alignment of the wire element is preferably carried out exclusively via the kinematic unit.

To grip a wire element, the upper part of the arm is moved towards the lower, fixed part of the arm. This closes the gripping jaws of the gripping element, which are e.g. formed at the ends of the partial arms. To open the gripper jaws, the upper part arm is moved upwards accordingly. Alternatively, the two partial arms can be moved relative to each other or together within the linear guide. Due to the relative movability, gripper jaws of the gripping element are moved up and down to grip the wire end. By moving the two partial arms together, the contact elements can optionally be aligned laterally.

The mobility of the two gripper arms is made possible by the kinematic units. The mobility, especially within the X-Y plane, allows the contact elements to be moved and especially aligned in order to insert them into the connector housing. This mobility on the part of the gripping elements that hold the contact elements is particularly advantageous if the connector openings for the contact elements are arranged at different positions within the X-Y plane.

In a preferred embodiment the kinematic units have six axes of motion and are designed in particular as so-called hexapods. The hexapod is a kinematic unit that enables very precise alignment of workpieces in three-dimensional space. The six motion axes are preferably three translational and three rotary motion axes. The mobility of the kinematic units designed as hexapods is achieved in particular by pneumatic or hydraulic cylinders. These cylinders are typically arranged between two support plates. One of the support plates is attached to the support and the respective gripping element is attached to the other support plate. The advantage of the design of the kinematic units as hexapods is that this enables the aforementioned mobility of the gripping elements in a simple and precise way.

In a preferred embodiment the gripping elements can be moved in longitudinal direction. The gripping elements can be moved in the longitudinal direction in order to insert the contact elements into the plug openings of the connector housing. In other words, the contact elements are inserted into the connector housing by moving the gripping elements in the longitudinal direction. The longitudinal movement is achieved either by moving the robot arm and thus the entire device or by moving the kinematic units in the longitudinal direction so that only the two gripping elements are moved in the longitudinal direction. In particular, the desired insertion of the contact elements into the corresponding plug openings in the connector housing is achieved by the movability in longitudinal direction.

In the preferred design, however, there is no movement (relative to the support) of the gripping elements or of the kinematic units in the longitudinal direction, in particular no feed movement for insertion the contact elements into the respective plug opening.

In a preferred embodiment the device is designed to perform a pull-out test. The pull-out test is performed in particular immediately after the contact elements have been inserted into the connector housing. The advantage here is that the device not only allows the contact elements to be assembled in the connector housing, but also allows a check to be made with regard to a mechanical holding force. The device is thus also designed to check the plug connection for a tight fit. The gripping elements are designed and controlled in such a way that they exert a predetermined pull-out force on the wire elements against the plug-in or longitudinal direction.

Preferably the gripping elements are force-monitored for this purpose. Force-monitored in this case means that the gripping elements preferably each have a force sensor. By means of this sensor, a force acting on the gripping elements, especially in or against the longitudinal direction, is detected and, if necessary, monitored. According to a first variant, a plug-in force is monitored when the contact elements are inserted into the connector housing. Alternatively, or additionally, according to a second variant, the force exerted is recorded and monitored during the pull-out test. The pull-out test is thus considered to have been passed if, for example, the force sensors detect a predetermined value while the gripping elements are being pulled on the wire ends located inside the connector housing without the contact elements being able to be pulled out of the connector housing, i.e. without releasing the contact elements from the housing.

This ensures a reliable as well as simple and cost-effective technical implementation of the pull-out test.

BRIEF DESCRIPTION OF THE DRAWINGS

The present invention will become more fully understood from the detailed description given hereinbelow and the accompanying drawings which are given by way of illustration only, and thus, are not limitive of the present invention and wherein.

DETAILED DESCRIPTION OF THE INVENTION

Figure 1:
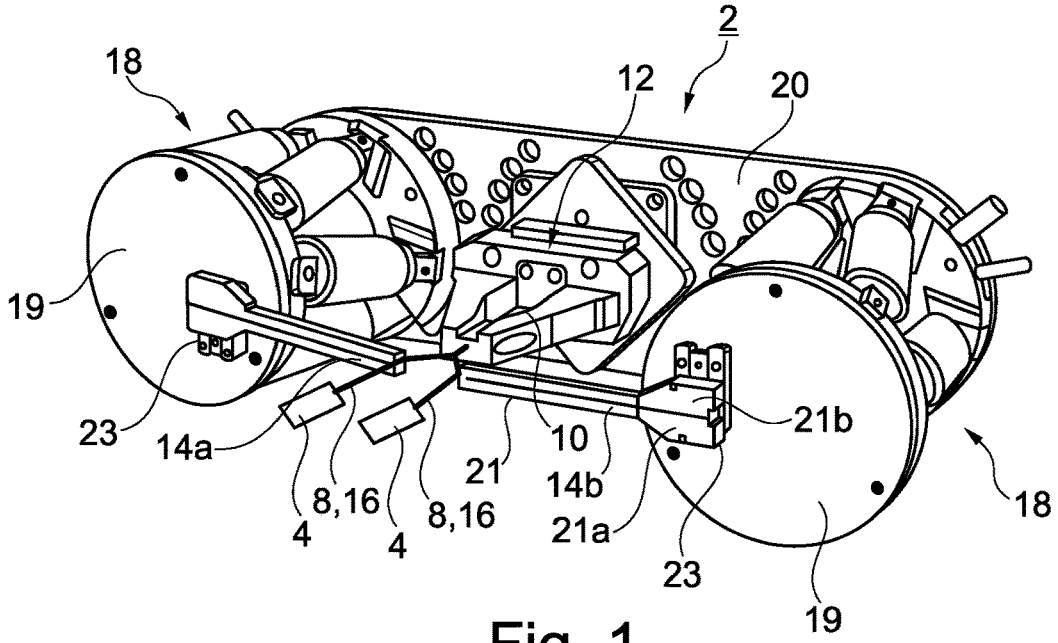
FIG. 1 is a perspective view of a device.
Figure 3:
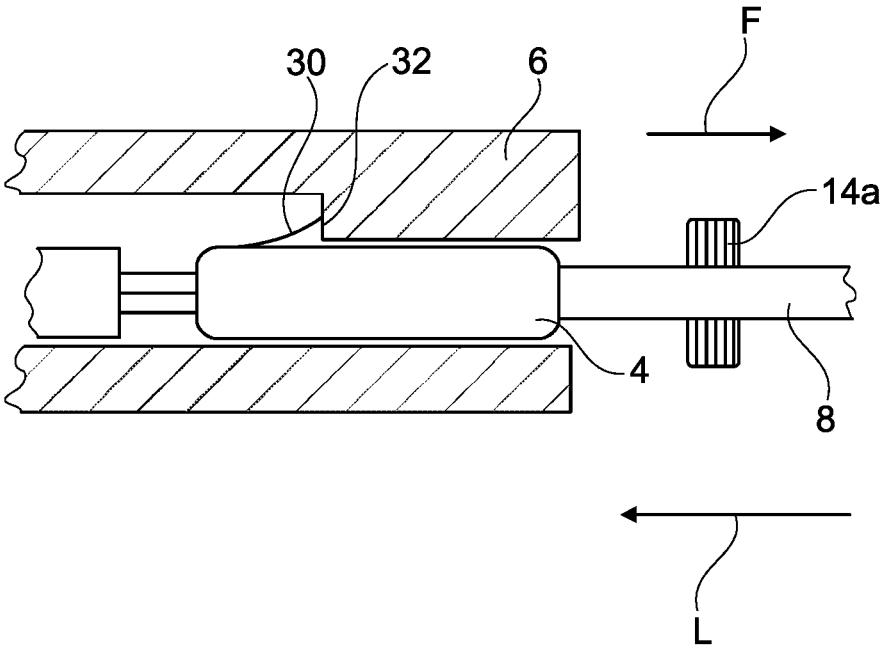
FIG. 3 is a side view of a longitudinal section of a sketched connector housing with contact element arranged therein.

The device 2 according to FIG. 1 is designed for the correct feeding of contact elements 4, which are only shown schematically, into a plug housing 6 (see FIG. 3). The contact elements 4 are each arranged at the end of a wire element 8 of a particularly twisted wire pair 10.

The device 2 has a main gripper 12, which in the design example is designed like pliers with two gripping legs. The main gripper 12 serves to grip the wire pair 10 and can be rotated about an axis of rotation D extending in a longitudinal direction L (see FIG. 2).

Furthermore, the device 2 has two gripping elements 14*a, b*, for gripping one end 16 of the respective wire element 8 The two gripping elements 14*a, b* are each arranged on a movable kinematic unit 18, which in turn are arranged in the design example on a support 20, which is in particular designed in the form of a plate.

The gripping elements 14*a,b* preferably each have a holding arm 21, which is attached to a front support plate 19 of the respective kinematic unit 18. The holding arm 21 runs perpendicular to the longitudinal direction L. The holding arm 21 and thus the respective gripping element 14*a,b* is also assigned a guide, in particular a linear guide 23. In particular, the respective holding arm 21 is attached to the kinematic unit 18 so that it can be moved via the guide. Via the linear guide 23, a transverse displaceability perpendicular to the longitudinal axis L and perpendicular to a longitudinal orientation of the holding arm 21 is possible. The holding arm 21 is preferably divided in the direction of its longitudinal orientation into two partial arms 21*a*, 21*b*, which can be displaced relative each other via the linear guide 23. Preferably, only one partial arm 21*a*, 21*b* can be moved. This allows them to be adjusted towards each other, e.g. to clamp or release the wire element 8. The respective wire element 8 is guided or held at the end of the holding arm 21, especially between two gripper jaws. Due to the movability of the partial arms 21*a*, 21*b* relative to each other, wire elements 8 with different diameters can be gripped.

The main gripper 12 is also arranged on the common support 20. In particular, the main gripper 12 is arranged centrally between the two gripping elements 14*a, b*.

The movable kinematic units 18 are designed as hexapods in the shown embodiment. In general, they are designed for several degrees of freedom of movement and preferably have translational and rotary degrees of freedom. For example, they have six axes of motion Xt, Yt, Zt, Xr, Yr, Zr. This makes it possible that the gripping elements 14*a,b* and thus also the wire ends 16 they grip with the contact elements 4 can be moved in six directions of movement, namely three translational directions Xt, Yt, Zt and three rotary directions Xr, Yr, Zr (see FIG. 2).

The kinematic units 18 are not limited to the design as hexapods. In general, the kinematic units 18 permit a rotary movement about a respective rotary or swivel axis d and preferably also a tilting movement, especially about the X-axis and/or the Y-axis. This allows the support plate 19 and thus the gripping elements 14 to be tilted relative to the longitudinal direction L. This allows an angular position, i.e. a longitudinal orientation of the contact elements 4, to be adjusted with respect to the longitudinal direction L. In particular, this allows the contact element 4 to be aligned axially parallel to the longitudinal direction.

Due to the kinematic units 18, in particular also in connection with the linear guide 23, the gripping elements 14*a, b* and thus the contact elements 4 can be moved, in particular within an X-Y plane E (see FIG. 2), which extends perpendicular to the longitudinal direction L. This enables a lateral alignment of the contact elements 4. The angular position can also be adjusted.

All in all, the device described here is characterized by the fact that, in addition to an alignment of the contact elements 4 in a desired rotary position, a further alignment (lateral, tilting) is also possible. This means that the device can be used universally for a wide range of applications, types of connector housings, wire types, etc. In addition, the same unit can also be used for infeed or plug-in movement. It is therefore not necessary to additionally grip the aligned wire elements 8 or contact elements 4 one more time in a second step.

During operation of the device 2, the two wire ends 16 of the wire pair 10 are gripped by the gripping elements 14*a,b*, while the wire pair 10 is preferably gripped in a twisted area by the main gripper 12. Then the respective contact elements 4 are brought into a predetermined rotary position by turning the main gripper 12 and thus by turning the wire pair 10. A further alignment is also carried out to bring the contact elements into a target position.

This design is based on the idea that the contact elements 4 must have a preferred and predetermined orientation (target position) in order to be inserted into the connector housing 6. The predetermined target position is understood to be a position of the contact elements 4 in which they can be inserted into the connector housing 6 for assembly. The two contact elements 4 must usually be aligned parallel to each other, in particular parallel to the axis of the plug openings, in the desired (same) rotary position and with a specified lateral distance (corresponding to the grid dimension of the plug openings).

The contact elements 4 are now brought into the specified rotary position in such a way that preferably only one of the gripping elements 14*a* (first gripping element 14*a*) releases a gripping force on the wire end 16, which it preferably holds in a rotary fixed manner, with the contact element 4 arranged thereon, so that the first gripping element 14*a* only loosely guides the wire end 16. Then the main gripper 12 and thus the wire pair 10 is rotated about the axis of rotation D so that the now only loosely guided wire end 16 also rotates. This brings the contact element 4 into the specified rotary position. Once this has been done, the first gripping element 14*a* fixes the contact element 4, which has been brought into the specified rotary position, by increasing the gripping force and this process is repeated with the contact element 4, which is held by the (second) gripping element 14*b* in the same way. The alignment of the contact elements 4 into the specified rotary position is thus preferably done by a purely rotary movement.

Then, for example, the contact elements 4 brought into the specified rotary position are further aligned by a translational and/or rotary movement of the kinematic units 18 and brought into a specified target position, for example in front of a plug opening (not shown here) of the connector housing 6. After this alignment, the contact elements 4 are inserted into the connector housing 6 by a movement in longitudinal direction L.

Figure 2:
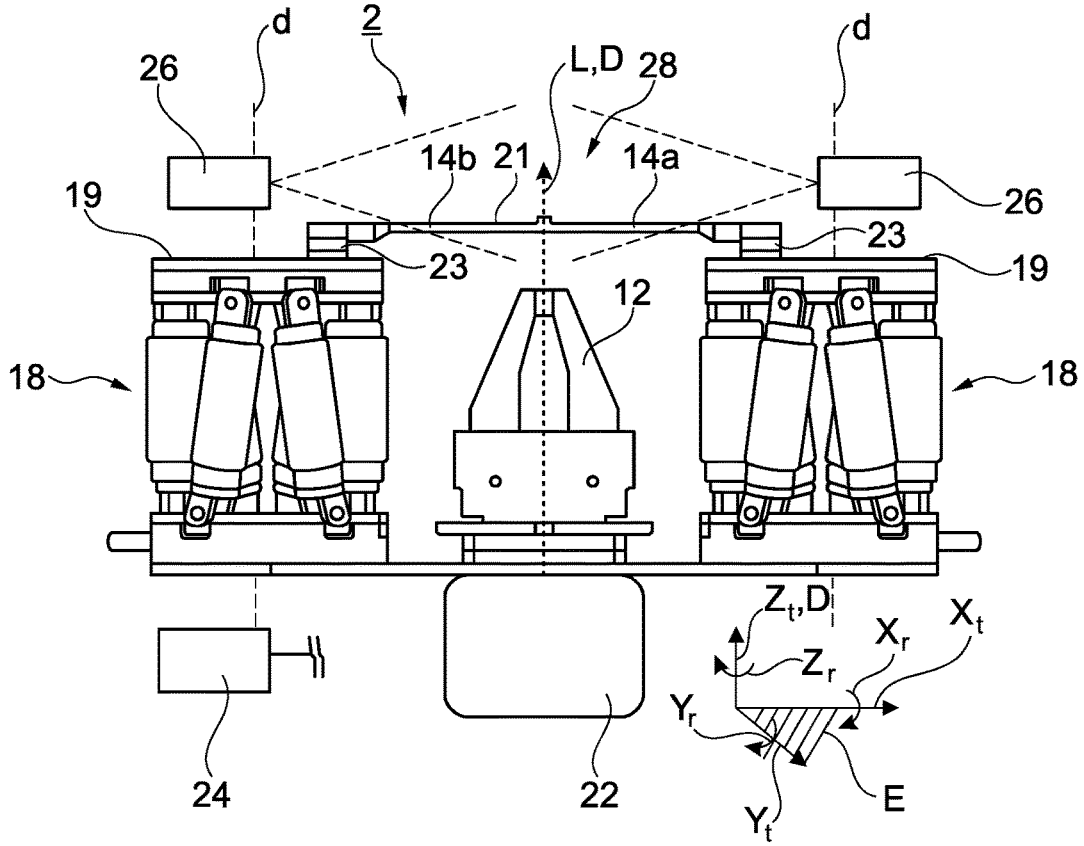
FIG. 2 is a top view of the device.

FIG. 2 shows a top view of fixture 2. Also shown in FIG. 2 is the arrangement of device 2 on a robot arm 22. The previously mentioned insertion of the contact elements 4 into the connector housing 6 is either done by a translatory movement of the kinematic units 18 along the longitudinal axis L. Preferably, the insertion is carried out (only) with a complete movement of the device 2 along the longitudinal axis L caused by the robot arm 22. Furthermore in FIG. 2 the control unit 24 is shown as a schematic rectangle. It is designed to control the device 2 and preferably also the robot arm 22 in such a way that the movements of the main gripper 12, the two gripping elements 14 *a,b* and the kinematic units 18 required to carry out the previously described assembly process are carried out.

In particular, this control is carried out fully automatically, i.e. without manual interaction by an operator. This has the particular advantage that a fully automated assembly of twisted pairs of wires is possible.

For the detection of a current position and for checking whether the contact elements 4 are each in the specified target position, the device 2 has a sensor unit 26. In the design example, this comprises two cameras that monitor a front area 28 of the device from two opposite directions. Preferably, it is also conceivable to arrange several cameras in such a way that the front area 28 is monitored from several directions. Within the front area preferably the movement of the contact elements 4 into the specified rotary/target position and the insertion of the contact elements into the connector housing 6 take place. The control unit 24 is designed in such a way that, depending on the sensor information generated by the sensor unit 26, the alignment of the contact elements 4 is carried out by translational and rotary movements of the elements 12, 14*a, b* and 18.

FIG. 3 shows a longitudinal section through a connector housing 6 with a contact element 4 inserted into it. FIG. 3 thus shows a final state of the assembly. A pull-out test is carried out in this state before the device is released. FIG. 3 only shows a schematic diagram of a gripping element 14*a* of device 2, which grips the wire element 8 like a pair of pliers. During the pull-out test, the contact element 4 inserted into the connector housing 6 is subjected to a pull-out force F by a movement of the device 2 against the longitudinal direction L. This serves to test whether it is possible to pull the contact element 4 out of the connector housing 6 with a pull out force which is below specified pull-out force F. Especially this serves to test if a latching element 30 arranged, for example, on the contact element 4, is latched to a latching contour 32 formed within the connector housing 6.

The invention is not limited to the embodiment described above. Rather, other variants of the invention can be derived from it by the person skilled in the art without leaving the subject matter of the invention. In particular, all individual features described in connection with the embodiments can also be combined with each other in other ways without leaving the subject matter of the invention.

The invention claimed is:

1. A device for automatically assembling at least a pair of wires including two wire elements each having a wire end with a contact element, the device, comprising:

a main gripper for jointly gripping the pair of wires, wherein the main gripper is rotatable about a common axis of rotation extending in a longitudinal direction;

two gripping elements, each one of the two gripping elements for respectively gripping the wire end of a respective one of the two wire elements; and a control unit for controlling the main gripper and the two gripping elements in such a way that in operation:

the wire end of each one of the two wire elements is gripped by the gripping elements, the pair of wires is gripped with the main gripper, and the two gripping elements are arranged laterally next to one another with respect to the longitudinal direction;

the control unit and the two gripping elements designed in such a way that during operation of the device:

a movement of the gripped wire ends takes place, said movement being selected from a translational alignment and a rotary alignment of the gripped wire ends relative to one another, the gripped wire ends are individually gripped by the gripping elements and the pair of wires is jointly gripped by the main gripper; and the respective contact element of at least one of the two wire elements is brought into a predetermined rotary position by rotating the main gripper about the common axis of rotation such that the jointly gripped pair of wires rotates jointly about the common axis of rotation.

2. The device according to claim 1, wherein the gripping elements are designed to enable said movement of the gripped wire ends within a projection plane perpendicular to the longitudinal direction.

3. The device according to claim 1, wherein the control unit controls the main gripper and the two gripping elements such that the respective contact element of each of the two wire elements is successively brought into the predetermined rotary position by:

first bringing the respective contact element of one of the two wire elements into the predetermined rotary position by rotating the pair of wires by the main gripper, subsequently non-rotatably holding the respective contact element, which was brought into the predetermined rotary position, by the gripping element which is assigned to the respective contact element, which was brought into the predetermined rotary position, and subsequently bringing the respective contact element of a further one of the two wire elements into the predetermined rotary position by rotating the pair of wires by the main gripper.

4. The device according to claim 1, wherein the main gripper and the gripping elements are arranged on a common support.

5. The device according to claim 4, wherein the support is designed for attachment to an adjustment mechanism.

6. The device according to claim 1, comprising a linear guide for a lateral alignment of the wire ends perpendicular to the longitudinal direction.

7. The device according to claim 1, comprising a kinematic unit for each of the two gripping elements, the kinematic units enabling the two gripping elements to move independently of one another.

8. The device according to claim 7, wherein at least one of the kinematic units is designed to execute a rotary movement about a pivot axis parallel to the common axis of rotation.

9. The device according to claim 7, wherein at least one of the kinematic units is adapted to perform a tilting movement with respect to the longitudinal direction.

10. The device according to claim 7, wherein the kinematic units have six axes of movement.

11. The device according to claim 1, wherein:

the two gripping elements each comprise a gripping arm; and the gripping arm of one of the two gripping elements and the gripping arm of another one of the two gripping elements are oriented towards each other in the direction of the axis of rotation.

12. The device according to claim 11, wherein the respective gripping arm of each of the two gripping elements is divided into two partial arms which are movable relative to each other for gripping the wire end of a respective one of the two wire elements.

13. The device according to claim 12, wherein the two partial arms are jointly linearly movable.

14. The device according to claim 1, wherein the two gripping elements are movable in the longitudinal direction.

15. The device according to claim 1, which is designed to perform a pull-out test after the contact elements have been inserted into a connector housing.

16. The device according to claim 1, wherein the two gripping elements are force-monitored.

17. A method for automatically assembling at least a pair of wires including two wire elements each having a wire end with a contact element, the method which comprises:

obtaining the device according to claim 1;

bringing the respective contact element into the predetermined rotary position by the following steps:

jointly gripping the pair of wires by the main gripper;

individually gripping each of the wire ends by one of the two gripping elements;

bringing the contact element of at least one of the two wire elements into the predetermined rotary position by rotating the main gripper about the common axis of rotation such that the jointly gripped pair of wires rotates jointly about the common axis of rotation; and performing an alignment of the gripped wire ends, said alignment being selected from a translational and a rotary alignment.

18. The method according to claim 17, wherein by the two gripping elements, the alignment of the gripped wire ends is performed within a projection plane perpendicular to the longitudinal direction.

19. The method according to claim 17, wherein, after the contact elements have been aligned in a respective predetermined desired position, the contact elements are inserted into a connector housing with the two gripping elements.

* * * * *